United States Patent [19]

Miyazawa

[11] 3,939,953

[45] Feb. 24, 1976

[54] COIN DISCRIMINATING APPARATUS

[75] Inventor: Kuniaki Miyazawa, Tokyo, Japan

[73] Assignee: Mitani Shoji Kabushiki Kaisha, Japan

[22] Filed: June 18, 1974

[21] Appl. No.: 480,466

[30] Foreign Application Priority Data

June 20, 1973 Japan ..... 48-68676
June 20, 1973 Japan ..... 48-68677
June 20, 1973 Japan ..... 48-68678

[52] U.S. Cl. ..... 194/100 A
[51] Int. Cl.[2] ..... G07F 3/02
[58] Field of Search ..... 194/100, 100 A, 99; 209/111.9; 133/3; 73/67.2, 67.1

[56] References Cited

UNITED STATES PATENTS

| | | | |
|---|---|---|---|
| 2,317,351 | 4/1943 | Andalikiewicz | 194/100 R |
| 3,012,649 | 12/1961 | White et al. | 194/100 R |
| 3,345,862 | 10/1967 | Rowe | 73/67.2 |
| 3,438,493 | 4/1969 | Goble | 209/111.9 |
| 3,543,930 | 12/1970 | Delbridge | 194/100 A |
| 3,608,715 | 9/1971 | Snyder et al. | 209/111.9 |
| 3,788,466 | 1/1974 | Wilson et al. | 209/111.9 |

*Primary Examiner*—Allen N. Knowles
*Attorney, Agent, or Firm*—Toren, McGeady and Stanger

[57] ABSTRACT

In a coin discriminating apparatus containing a feedback oscillator circuit having a feedback loop, a mechanical filter is arranged and includes a discriminated coin, a speaker to vibrate the coin and a sensor to pick up the vibration of the coin; a one cycle selector for taking out one period of the vibration frequency generated at the oscillator circuit; means for quantizing the output signal of the one cycle selector by clock pulses; counter means including a scale-of-1000 counter and a decoder for counting the number of clock pulses; and bistable circuit means whose state is reversed on receipt of an output produced at the decoder when contents of the counter run up to the lower limit or the upper limit of a tolerance predetermined under the crossing rate distribution for natural frequencies of a genuine coin.

14 Claims, 7 Drawing Figures

COIN DISCRIMINATING APPARATUS

BACKGROUND OF THE INVENTION

This invention relates to a coin discriminating apparatus adapted for use with an automatic vendingmachine, automatic money changing machine, automatic accounting machine and the like.

In one type of coin discriminating apparatus known in the art, the external dimensions of a coin are measured to discriminate between different types of coins. In another type, the weight of a coin is measured to distinguish between different types of coins.

The former type has the disadvantage of not being able to discriminate between a genuine coin in circulation and a false coin which has the same external dimensions. The latter type has a similar disadvantage.

In still another type of coin discriminating apparatus known in the art, discrimination between coins is effected by measuring both external dimensions and weight. This type permits discrimination of coins to be carried out with a slightly higher degree of precision. However, this type has the disadvantages of being complex in construction and lower in efficiency than the aforementioned two types. Moreover, this type is unable to discriminate between a genuine coin in circulation and a false coin which is made such that it has the same external dimensions and weight as the genuine coin.

Generally, an object placed in a free space has the properties of being a medium of vibration, and the rate at which acoustical vibrations are transmitted through the medium in the form of vertical waves or transverse waves can be expressed as a function of density, Young's modulus and Poisson's number which are inherent properties of the object. Density is a physical quantity which may vary depending on external dimensions and weight. On the other hand, Young's modulus and Poisson's number are physical quantities which are concerned with the material of the object when sound waves are transmitted.

Measurements of specific resonance frequency of a coin which may vary depending on its physical qualities show that, since a particular coin in circulation has external dimensions which are predetermined and its material has a density which is constant, the nature frequency of such coin is constant and that the coin has sharp resonance characteristics when excited at its natural frequency. When a coin is subjected to impacts in free space, it vibrates in various modes and produces sound waves characteristic thereof which include its natural frequency. Since natural frequency is determined by the external dimensions and weight of the coin and the density of its material, it is possible to discriminate between two types of coins with a high degree of precision by measuring the natural frequency of each coin.

In using this system for testing a coin to find out whether it is genuine or false or what type of coin it is, the coin to be tested must be made to vibrate correctly at its natural frequency. To this end, the coin to be tested can be excited by a speaker, its vibration can be sensed by a pressure sensitive senser, and selective oscillation can be initiated by means of a feedback loop. In this type of coin discriminating apparatus, it is required to arrange the exciter and the receiver in a manner such that they are disposed specially in close proximity to each other. This arrangement generally causes howling to take place, so that it is not desirable to use a device for detecting sound waves which does not rely on contacts as is the case with the combination of a speaker and a microphone.

Proposals have been made to use a system wherein a coin is brought into engagement with a contact member so that the latter may detect the vibration of the former as a mechanical vibration, and the mechanical vibration is received by a pressure sensitive senser made of barium titanate or other dielectric material which converts it into an electric signal. When the contact member affixed to the senser is not made by a suitable material, a noise will be produced between the contact member and the coin when the latter is brought into engagement with the former. Thus, the noise is added to the natural frequency of the coin, making it difficult to discriminate between one type of coin and another.

Also, if the vibration of a coin is reversed in phase with respect to the acoustic frequency of the speaker, the vibration of the coin will be damped and no vibration of the coin will take place at all. This phenomenon will occur between coins of the same type when there are differences betwen them in the dimensions, shape, weight and other physical quantities of coins.

SUMMARY OF THE INVENTION

Accordingly, a main object of the invention is to provide a coin discriminating apparatus which is capable of discriminating between a genuine coin in circulation and a false one with a high degree of precision and a high degree of efficiency.

Another object of the invention is to provide a selective oscillator circuit which causes a coin fed to the apparatus to vibrate at its own natural frequency, so that a correct natural resonance frequency of the coin can be taken out.

Another object of the invention is to provide a mechanical filter mechanism which is capable of absorbing and eliminating a noise which might otherwise be produced when a coin vibrates, so that the natural frequency alone of the coin can be transmitted.

Still another object of the invention is to provide means whereby the phase of vibration of a coin can be instantaneously brought into agreement with the phase of vibration of the oscillator.

Still another object of the invention is to provide a coin discriminating apparatus in which a coin fed to the apparatus can be determined to be either genuine or false by comparing the natural resonance frequency of such coin with the natural resonance frequency of genuine coins of the same type as the coin fed to the apparatus.

Still another object of the invention is to provide a coin discriminating apparatus which can distinguish between genuine and false coins and which can be coupled to the change dispensing mechanism whereby the latter mechanism can be rendered operative when a coin fed to the apparatus is found to be a genuine coin.

A further object of the invention is to provide means whereby a coin fed to the apparatus can be determined to be either genuine or false when the output of the selective oscillator circuit has reached a predetermined level after the circuit is actuated by such coin.

According to the invention, there is provided a coin discriminating apparatus comprising a mechanical filter mechanism including a speaker, a pressure sensitive senser and a coin fed to the apparatus and interposed between such speaker and such sensor, a selective oscillator circuit adapted to oscillate at the mechanical nature frequency of the coin fed to the apparatus, a one cycle selection circuit adapted to take out one cycle alone of the frequency at which such selective oscillator circuit oscillates, means for producing impulses whose number depends on the wavelength of such one cycle each time a coin is fed to the apparatus, and means for determining whether or not the number of pulses is within a predetermined range.

DESCRIPTION OF THE DRAWING

Additional and other objects and features of the invention will become evident from the description set forth hereinafter when considered in conjunction with the accompanying drawings, in which.

DESCRIPTION OF THE INVENTION

Figure 1:
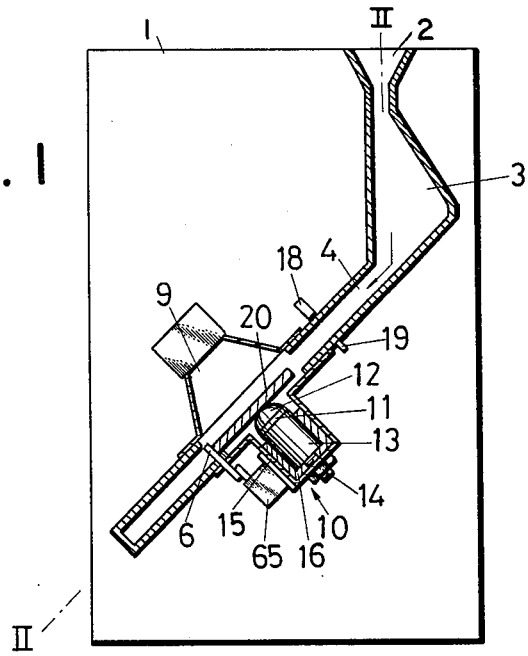
FIG. 1 is a vertical sectional side view of the mechanical filter mechanism of the coin discriminating apparatus according to the invention.
Figure 2:
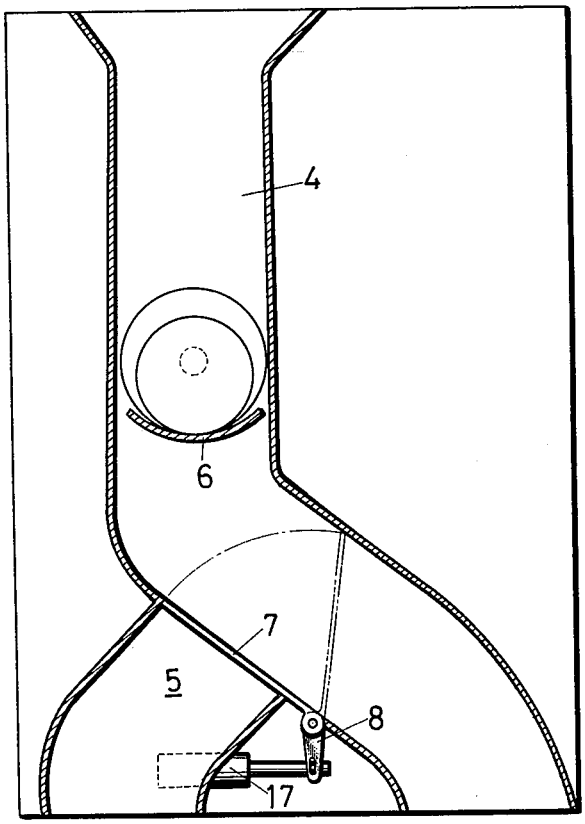
FIG. 2 is a sectional view taken along the line II—II of FIG. 1.
Figure 3:
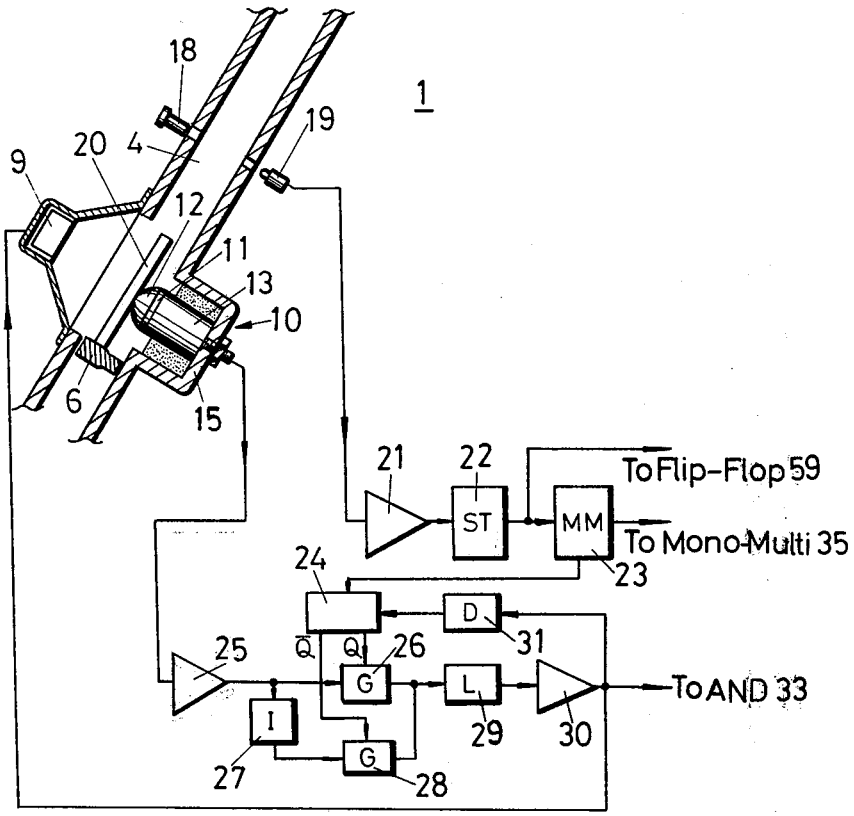
FIG. 3 is a view showing the mechanical filter mechanism and the selective oscillator circuit of the coin discriminating apparatus according to the invention.

An embodiment of the invention will now be described in detail with reference to the accompanying drawings. Referring to FIG. 1 to FIG. 3, a coin 20 introduced into a coin discriminating apparatus 1 through a coin inserting port 2 passes through a direction changing chamber 3 and temporarily stops as it is caught by an arcuate stopper 6 mounted in an inclined coin passageway 4 which is inclined with respect to both a horizontal plane and a vertical plane. Also mounted in the passageway 4 are a pressure sensitive senser 10 and a speaker 9 which are disposed in spaced juxtaposed relationship, with the coin 20 being interposed therebetween while being stopped temporarily by the stopper 6.

The pressure sensitive senser 10 comprises a piezo-electric element 11 made as of barium titanate, a semi-spherical tip 12 made of plastics and attached to the top of the element 11, and a base 13 attached to the bottom of the element 11. The base 13 is secured by a nut 14 to a holder 15 affixed to a frame attached to the inclined coin passageway 4. A buffer 16 is interposed between the holder 15 and the base 13. The pressure sensitive senser 10 is mounted such that the tip 12 extends into the passageway 4 and supports at its head the coin 20 substantially at the middle of one side thereof. On the other hand, the speaker 9 is mounted such that it is possible effectively to apply sound waves to the other side of the coin 20 maintained in contact with the tip 12 on the opposite side.

The buffer 16 is adapted to absorb vibration applied to the coin discriminating apparatus from outside so that such vibration may not be transmitted to the piezo-electric element 11 as a noise. Excellent results can be achieved if a porous material is employed as the buffer 16.

A coin is preferably held substantially on a diametric line when held at two points, in order that its natural frequency can be correctly determined. According to the invention, the tip 12 is disposed substantially in the center of the inclined coin passageway 4 width-wise thereof as shown in FIG. 2. It is thus necessary that the coin 20 should be brought into contact with and held by the stopper 6 substantially in the center of the inclined passageway 4 width-wise thereof. As shown in FIG. 2, the stopper 6 provides a circularly arcuate surface which has a radius of curvature greater than that of any type of coin in circulation so that the aforementioned requirement may be met at all times regardless of the type of the coin fed to the apparatus. The stopper 6 whose center of curvature is disposed substantially in the center of the inclined coin passageway 4 width-wise thereof can move between a forward or operative position in which it extends into the inclined coin passageway 4 to catch and hold the coin and a rearward position or inoperative position in which it is withdrawn from the inclined coin passageway 4 and does not perform a coin stopping action.

No matter what course of movement a coin may follow when moving through the inclined com passageway 4, its position is controlled by the stopper 6 when it impinges on the latter, so that it is held by the curved surface of the stopper 6 and disposed substantially in the center of the inclined passageway width-wise thereof.

Upon sound waves being produced by the speaker 9, the coin 20 moves in vibratory motion. The vibration of the coin 20 is directly transmitted to the tip 12 made of plastics, e.g. epoxy resin, which differ from the material of the coin 20 in the rate of transmission of sound. Thus, it is only the vibration of the coin 20 that is transmitted to the piezo-electric element 11. The tip 12 is preferably in the semi-spherical form. A noise of high transmission rate, such as the sound produced by the hammering effect of the coin 20 on the tip 12, is absorbed by the tip 12. Other noises from outside are absorbed by the buffer 16, so that it is substantially the pure vibration of the coin 20 that is transmitted to the piezo-electric element 11.

7 designates an opening and closing plate which is under the influence of a solenoid 17 and moves between open and closing positions to open and close a branch passageway 5 branching off the inclined coin passageway 4 as shown in FIG. 2. When the coin 20 is determined to be a false one, the opening and closing plate 7 is brought to an open position to permit the coin 20 to move through the branch passageway 5 to a coin return port or the like.

18 designates a light emitting diode functioning as a light source, and 19 is a phototransistor functioning as a light receiving element. The light emitting diode 18 and phototransistor 19 constitute a coin passage detector. As is well known, when the coin 20 moves through the path of light emitted by the light emitting diode 18, a coin passage detection pulse is produced by the phototransistor 19. In case the coin 20 is a perforated coin, two pulses are produced. The coin passage detection pulse or pulses are amplified by an amplifier 21 and supplied to a Schmitt trigger circuit 22, as shown in FIG. 3, where they have their wave form shaped as shown in 1 of FIG. 5 and 15 of FIG. 6 as a starting signal $S_1$ which actuate a monostable multivibrator 23. At this time, an output pulse $S_5$ (see FIG. 5) of the monostable multivibrator 23 connects as astable multivibrator 24 to the power source to render the same operative.

On the other hand, the piezo-electric element 11 of the pressure sensitive senser 10 is connected to the input terminal of an amplifier 25, and the speaker 9 is connected to the output terminal of a second amplifier 30 connected to the amplifier 25. This closed loop constitutes an oscillator circuit. In this case, the pressure sensitive senser 10, speaker 9 and coin 20 interposed therebetween constitute a sort of mechanical filter. More specifically, the coin 20 subjected to sound waves supplied from the speaker 9 has sharp filtering characteristics such that it vibrates only when the sound waves to which it is subjected have a frequency which is identical with the natural frequency of the coin 20 and that it does not essentially vibrate when the frequency of the sound waves is distinguished from its natural frequency.

A gate 26 and a limiter 29 are interposed between the two amplifiers 25 and 30. A series circuit comprising a phase inverter 27 and a gate 28 is connected in parallel to gate 26. The aforementioned astable multivibrator 24 functions alternately to open and close the two gates 26 and 28. The gates 26, 28 and phase inverter 27 constitute a phase change-over switch circuit which may be constructed such that output signals differing from each other in phase by 180° are taken out from the collector and emitter of a front transistor which is used by being grounded through its emitter, and supplied to to each control input terminal of two transistors which are alternately switched by the output of the astable multivibrator 24.

Upon the coin fed to the apparatus impinging on the stopper 6 and being positioned as shown in FIG. 3, the positive feedback loop of the oscillator circuit is closed. More specifically, the shock vibration of the coin 20 produced when it impinges on the stopper 6 or a noise in the circuit is amplified and appears in the output terminal of amplifier 30 to actuate the speaker 9. The speaker 9 produces a sound output which causes the coin 20 to vibrate, so that the vibration of the coin 20 can be sensed by the pressure sensitive senser 10. If the vibration of the coin 20 is reversed in phase with respect to the vibration of the speaker 9, then the vibration of the coin 20 is damped and the coin 20 does not vibrate after all. This phenomenon may occur between coins of the same type due to differences in physical quantities, such as the dimensions, shape and weight of the coins. In order to obviate this problem, the astable multivibrator 24 is rendered operative for a predetermined time interval to switch the phases so as to lock the positive feedback loop in this stable point. This operation is performed as presently to be described.

As aforesaid, the astable multivibrator 24 begins to operate when the passage of the coin is detected by the phototransistor 19 so as alternately to open and close gates 26 and 28 during the time the monostable multivibrator 23 continues to produce an output. Then, after the coin 20 is brought to the position shown in FIG. 3, a positive feedback loop is formed when either gate 26 or 28 is opened, and the selective oscillator circuit oscillates. A relatively large output appearing at amplifier 30 is converted into a bias potential by a rectifier circuit 31 and impressed on the astable multivibrator 24, thereby locking the latter to a stable point at which the selective oscillator circuits oscillates. Thus, either of the gates which meets the requirement of oscillation is continuously opened, and the selective oscillator circuit selectively oscillates at the natural frequency of the coin 20. This causes an oscillation output signal $S_2$ (FIG. 5) of a constant voltage to appear at the output terminal of amplifier 30. The frequency of the oscillation output signal may vary depending on the type of the coin as aforementioned. It is about 13 KHz when the coin is a 10 yen coin, about 18 KHz when it is a 100 yen coin and about 19 or 20 KHz when it is a 50 yen coin.

Figure 4:
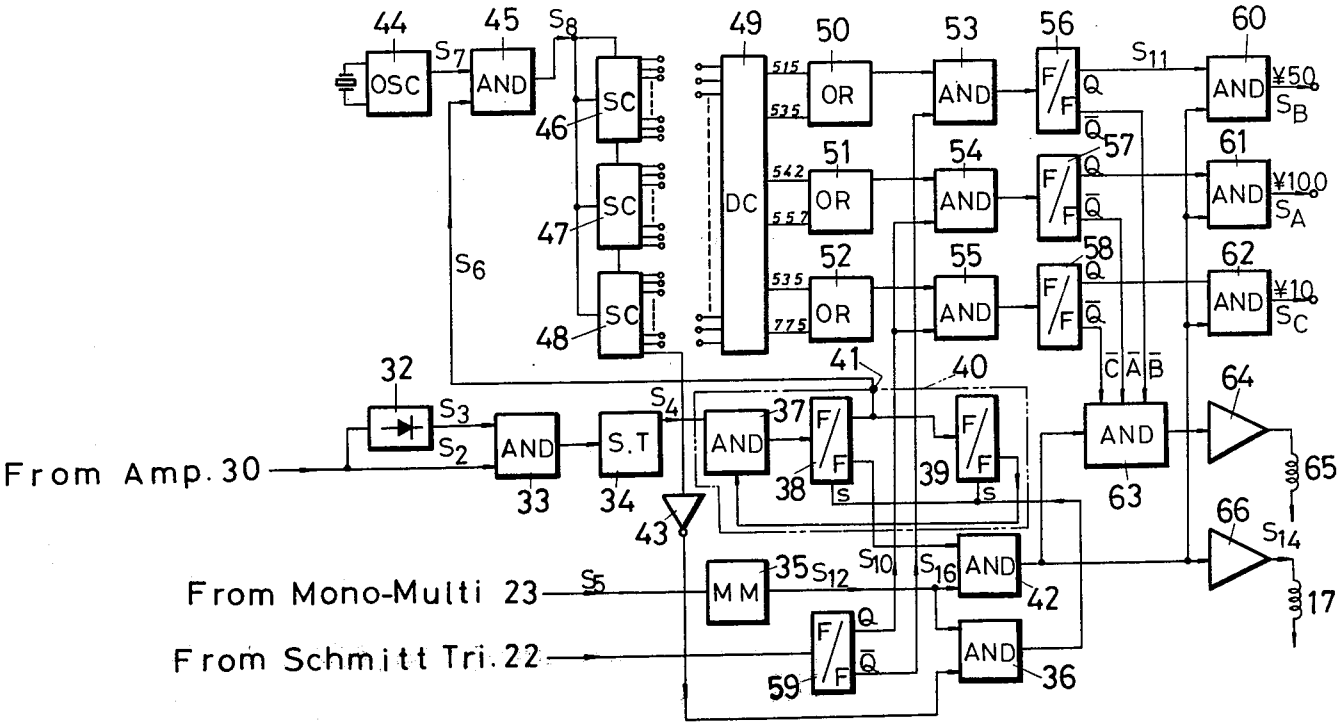
FIG. 4 is a block diagram of the one cycle selection circuit and the means for determining whether a coin fed to the apparatus is genuine or not of the coin discriminating apparatus according to the invention.

Referring to FIG. 4, the oscillation output signal $S_2$ has its wave form shaped at a Schmitt trigger circuit 34 and then is supplied to a one cycle selection circuit 40. A CW-IW discriminating circuit or a definite oscillation discriminator for discriminating between continuous waves and impulse waves comprising an AND circuit 33 and a rectifier circuit 32 connected across the both inputs of the AND circuit 33 is disposed anterior to the Schmitt trigger circuit 34 between the selective oscillation circuit and the one cycle selection circuit 40 so as to prevent the Schmitt trigger circuit 34 from being rendered operative by a pulse signal produced when a false coin is inserted in the apparatus or by shock waves produced when the automatic vending machine is violently moved. More specifically, the AND circuit 33 is not opened till the oscillation output signal is rectified into a signal $S_3$ (FIG. 5) and its DC potential reaches a predetermined level. If the output signal is a continuous wave, then the AND circuit 33 is opened after a delay of about 500 microseconds and the Schmitt trigger circuit 34 produces a signal $S_4$ as shown in 4 of FIG. 5.

On the other hand, the monostable multivibrator 23 (FIG. 3) as a waiting timer which has been in operation since the phototransistor 19 has produced a coin detection pulse changes its operation from one stable state to another after lapse of a predetermined time interval or 200 milliseconds, for example, and triggers a monostable multivibrator 35 as a collation processing timer to cause the same to produce a processing time pulse $S_{12}$. The rise of this pulse opens an AND circuit 36, thereby rendering the one cycle selection circuit 40 operative.

The one cycle selection circuit 40 comprises a main flip-flop 38 and a sub flip-flop 39 connected in cascade connection with each other, and an AND circuit 37 disposed anterior to flip-flop 38. Flip-flop 39 has an output terminal which is connected to one input terminal of AND circuit 37. Each of the flip-flops 38 and 39 may be preset with the collation finishing pulse $S_{12}$ from the monostable multivibrator 35.

When this occurs, the output terminal of flip-flop 39 becomes high in potential, and its output is impressed on AND circuit 37 which is opened by the output signal of flip-flop 39 and the output pulses of the aforementioned Schmitt trigger circuit 34, so that the output pulses of Schmitt trigger circuit 34 are successively supplied to flip-flop 38. The nature of state of flip-flop 38 is reversed upon receipt of a first input pulse and reversed again upon receipt of a second output pulse. At this time, flip-flop 39 changes to the other stable state to close AND circuit 37, thereby latching flip-flop 38. In other words, the one cycle selection circuit 40 operates for a time interval corresponding to one cycle of its input pulse train and produces a corresponding pulse $S_6$ at its terminal 41.

The pulse $S_6$ is applied as a sampling pulse to one input terminal of an AND circuit 45 which is connected, at the other input terminal thereof, to a clock oscillator 44 of about 10 KHz, for example. A portion of an output pulse train $S_7$ of the oscillator 44 which corresponds to the duration of the sampling pulse $S_6$ is taken out by the action of AND circuit 45. The number of pulses $S_8$ taken out of the pulse train $S_7$ is counted by counter means comprising a scale-of-1000 counter consisting of three ring counters 46, 47 and 48 and a decoder 49 consisting of three decoder units.

In the embodiment shown and described, three ring counters are used. It is to be understood that the invention is not limited to this number of ring counters and that one ring counter may be employed because the natural frequency of some type of coin is low. This is also the case with the decoder 49.

The number counted by the counter means is determined by the ratio of the natural frequency of the coin to the frequency of oscillation of clock oscillator 44. However, there are slight individual variations in natural frequency from one genuine coin to another even if they are of the same type. The results of tests show that one cycle of the natural frequencies of 50 yen coins, 100 yen coins and 10 yen coins range from 51.5 to 53.5 microseconds, 54.2 to 55.7 microseconds and 73.5 to 77.5 microseconds respectively. This means that, when the frequency of oscillation of the clock oscillator 44 is 10 MHz, the values for the genuine 50 yen, 100 yen and 10 yen coins exist in the ranges of numbers counted which are 515 to 735, 542 to 557 and 535 to 775 respectively. For the sake of convenience, the minimum number of each of the aforementioned ranges of allowable values for coins will be referred to as a leading value and the maximum number as a trailing value.

Output terminals of the decoder 49 indicating the leading and trailing values of each range of allowable values for coins are connected or OR circuits 50, 51 and 52 each consisting of three NAND gates mounted in combination. OR circuits 50, 51 and 52 each have an output terminal which is connected to one input terminal of AND circuits 53, 54 and 55 respectively. In FIG. 4, the decoder 49 and each OR circuit is connected together by two solid lines. Since the numbers indicated by the decoder 49 have three digit positions, each solid line represents three leads.

Opening and closing of AND circuits 53, 54 and 55 depend on whether the coin fed to the apparatus is perforated or not. More specifically, there is provided a flip-flop 59 for discriminating between perforated and non-perforated coins which has an input terminal connected to the output terminal of Schmitt trigger circuit 22 shown in FIG. 3. Flip-flop 59 has two output terminals, one output terminal Q being connected to the other input terminal of each of AND circuits 54 and 55 and the other output terminal Q being connected to the other input terminal of AND circuit 53.

When the Schmitt trigger circuit 22 shown in FIG. 3 produces only one output pulse or the coin fed to the apparatus is a non-perforated coin, an output pulse $S_{10}$ is produced at the output terminal Q of the flip-flop 59, thereby opening AND circuit 53. When the coin fed to the apparatus is a perforated coin, Schmitt trigger circuit 22 produces two putput pulses and the state of flip-flop 59 is reversed, so that a pulse 16 is produced at the output terminal Q of flip-flop 59 and flip-flops 54 and 55 are opened. Thus, when the coin fed to the apparatus is a non-perforated coin, flip-flop 56 is rendered operative, and when it is a perforated coin, flip-flops 57 and 58 are rendered operative.

Being connected as aforementioned, OR circuits 50, 51 and 52 each produce a first output pulse (leading value pulse) when the number counted by the counter means reaches the leading value after starting with zero. The first output pulse is applied as an input signal to discriminating flip-flops 56 or 57 and 58 through rear AND circuits 53 or 54 and 55, so that the nature of state of each flip-flop is reversed. When the number counted has reached the trailing value, a second output pulse (trailing value pulse) is produced to cause discriminating flip-flops 56 or 57 and 58 to change the nature of state to the original state.

Thus, when the number of pulses taken out in accordance with the duration of the cycle of the natural frequency of the coin fed to the apparatus is within the predetermined range of allowable values for the particular coin or between the leading and trailing values, OR circuits 50, 51 and 52 produce a leading value pulse when the number counted reaches the leading value, but no trailing value pulse is produced. Therefore, the OR circuits produces only one output pulse as shown in 9 of FIG. 5, with a result that flip-flops 56, 57 and 58 have their nature of state reversed by the leading value pulse and remsins in that state. This indicates that the coin fed to the apparatus is a genuine coin. Conversely, when the number of pulses taken out is not within the predetermined range of allowable values and is smaller than the leading value or greater than the trailing value, neither the leading value pulse nor the trailing value pulse is produced or both of them are produced (18 in FIG. 6). Thus, the nature of state of flip-flops 56, 57 and 58 is not reversed or restored to its original state after being reversed once, thereby indicating that the coin fed to the apparatus is a false coin.

The advantage of the aforementioned process of discriminating between genuine and false coins is that, even when the number of pulses taken out extends from outside to inside of the predetermined ranges of allowable values and greater than the leading value of each range, both the leading value pulse and the trailing value pulse are produced and the flip-flops are restored to their original position by reversing their nature of state twice, thereby indicating that the coin fed to the apparatus is a false coin.

An output $S_{11}$ of flip-flops 56, 57 or 58 is passed through AND circuits 60, 61 or 62 and appears at a terminal B, A or C as a discrimination output signal $S_B$, $S_A$ or $S_C$ (in 13 of FIG. 5 and 18 of FIG. 6), indicating that the coin is a genuine 50 yen coin, 100 yen coin or 10 yen coin. The discrimination output signal may be applied as an input to a coin number counter device of an automatic vending machine, for example.

AND circuits 60, 61 and 62 perform the function of eliminating a pulse S19 which is produced by the leading value pulse and the trailing value pulse before the oscillation of the selective oscillator circuit reaches a predetermined level. Initiation of vibration of the coin necessarily has a certain time lag behind feeding of the coin to the apparatus. It is necessary that the pulse $S_{19}$ produced by the reversion of the nature of state of flip-flop 56, 57 or 58, which takes place twice during the time the number of pulses produced by the vibration of the coin is being counted, be prevented from appearing at discrimination output terminal A, B or C. To this end, AND circuit 60, 61 or 62 is opened only when an AND circuit 42 produces an output. AND circuit 42 has two input terminals, one of them being connected to a reverse output terminal of the flip-flop 38 of the one cycle selection circuit 40 and the other being connected to the output terminal of monostable multivibrator 35. Thus, AND circuit 42 produces an output after the monostable multivibrator 23 shown in FIG. 1 has operated for about 200 millseconds and when the operation of monostable multivibrator 35 of the next stage is initiated, so that AND circuit 60, 61 and 62 are opened for about 200 millseconds during which monostable multivibrator 35 remains in operation.

As aforementioned, the output terminals of flip-flops 56, 57 and 58 connected to AND circuits 60, 61 and 62 are genuine coin discrimination output terminals. Thus, the other output terminal of each of flip-flops 56, 57 and 58 produces an output signal B, A or C indicating that the coin is not a coin of interest. The output signals B, A and C pass through an AND circuit 63 and are supplied to an amplifier 64 where they are amplified to energize a discrimination solenoid 65. AND circuit 63 is constructed such that it is opened when AND circuit 42 produces a collation ending signal $S_{14}$. The collation ending signal of AND circuit 42 is amplified at an amplifier 66 and used to energize a release solenoid 17. Thus, as soon as AND circuit 42 produces an output signal, the stopper 6 mounted in the coin passageway of the coin discriminating apparatus 1 is pulled by solenoid 17 against the biasing force of a spring (not shown) to move to an inoperative position so as to release the coin 20 from the position shown in FIG. 2. When the coin 20 is a false one, solenoid 65 is also energized to open the opening and closing plate 7 to return the coin 20 to the return port through the branch passageway 5. In case the coin 20 is genuine one, the opening and closing plate 7 is not actuated, so that the coin 20 is introduced into a coin classification mechanism.

When the counter 48 overflows or when the 900th number is counted thereby, AND circuit 36 is closed through an inverter 43, thereby resetting the flip-flops 38 and 39 of the one cycle selection circuit 40. This closes AND circuit 45 and reduces the input to the counter means to zero, thereby preventing misoperation of the counter means. Thus, the coin discriminating apparatus is brought to a state in which it is possible to start another coin discrimination operation if another coin is fed to the apparatus again.

Figure 5:
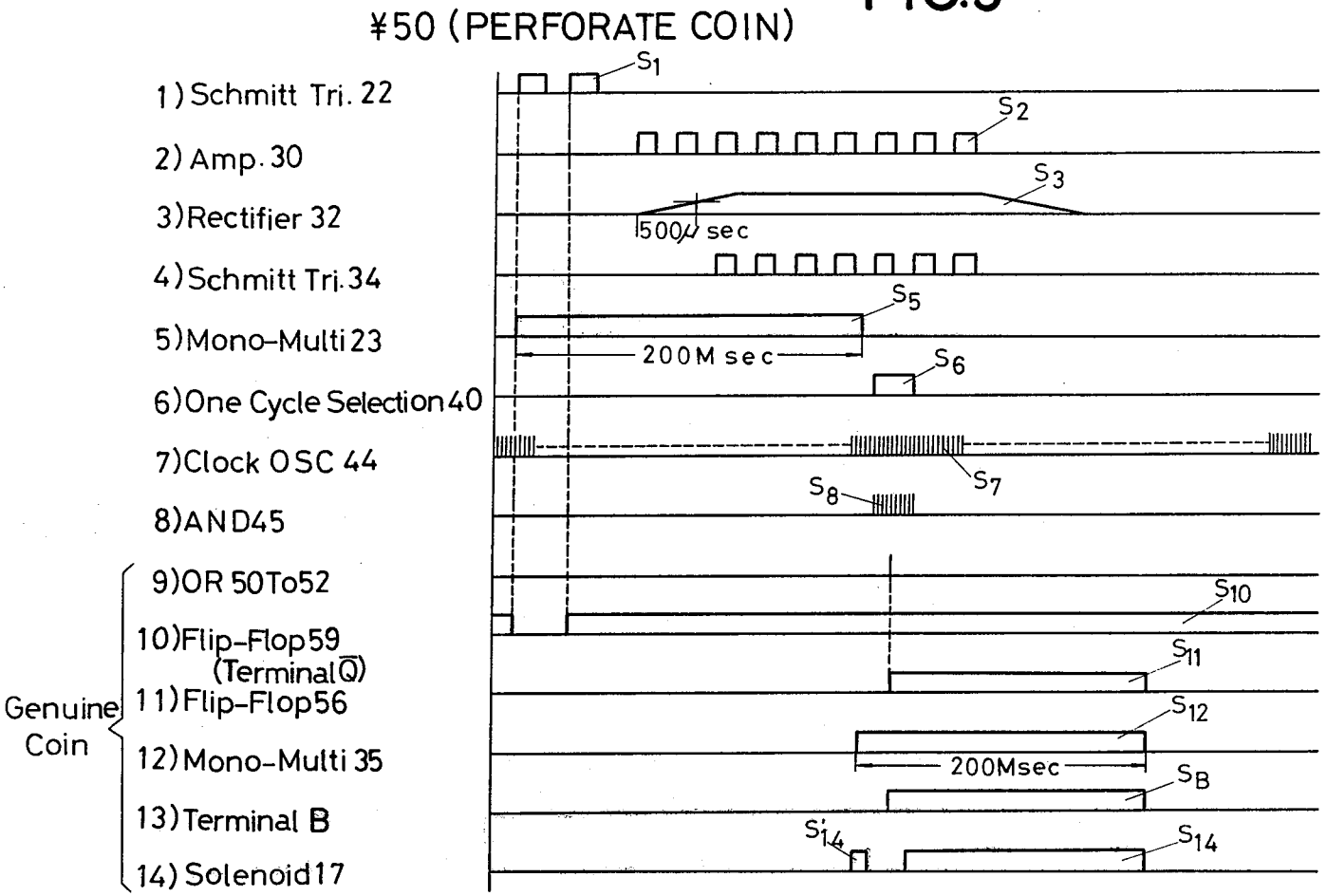
FIG. 5 is a time chart showing the operation of various elements of the one cycle selection circuit and the means for determining whether a coin fed to the apparatus is genuine or not when the coin is a perforated coin.
Figure 6:
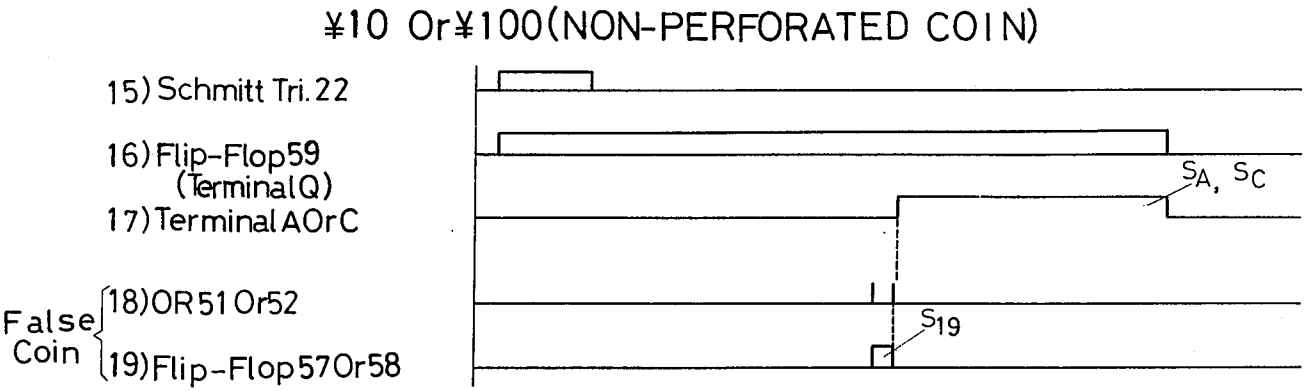
FIG. 6 is a view similar to FIG. 5 but showing the elements in operation when a coin to be discriminated is a non-perforated coin.

A signal portion S'14 remaining in front of the signal S14 shown in 14 of FIG. 5 practically exerts no influences on the operation of the solenoids. However, since the solenoids are mounted in the neighborhood of the pressure sensitive senser 7, it is desirable to provide an integration circuit or the like in amplifiers 64 and 66 to prevent interference by the senser.

In the embodiment shown and described, the decoder 49 consists of three decoder units corresponds to the digits of a decimal number in the positions of ones, tens and hundreds respectively. One output terminal of each decoder unit is connected through a lead to one of two input terminals of OR circuits 50, 51 and/or 52.

By this arrangement, it is possible to vary at will the duration of a selected cycle of natural frequency later on according to the type of coin to be discriminated.

The coin discriminating apparatus according to the invention can be constructed in part or in its entirety by utilizing the technology of large scale integration. When this is the case, it is advantageous to mount the decoder such that its connection can be varied.

According to the invention, the oscillator circuit is automatically switched between different phases by the astable multivibrator 24 and locked in the phase which suits the condition of oscillation. This ensures that oscillation takes place positively.

The presence or absence of oscillation can be ascertained by the action of the rectifier circuit 32 and AND circuit 33. The solenoid 17 for the stopper 6 is not energized when counting of the number or an arithmetic operation is in progress, and no output signal is produced at the output signal terminal A, B or C, so that the performance of the apparatus is dependable.

The apparatus according to the invention can discriminate between perforated and non-perforated coins, in addition to between genuine and false coins.

Figure 7:
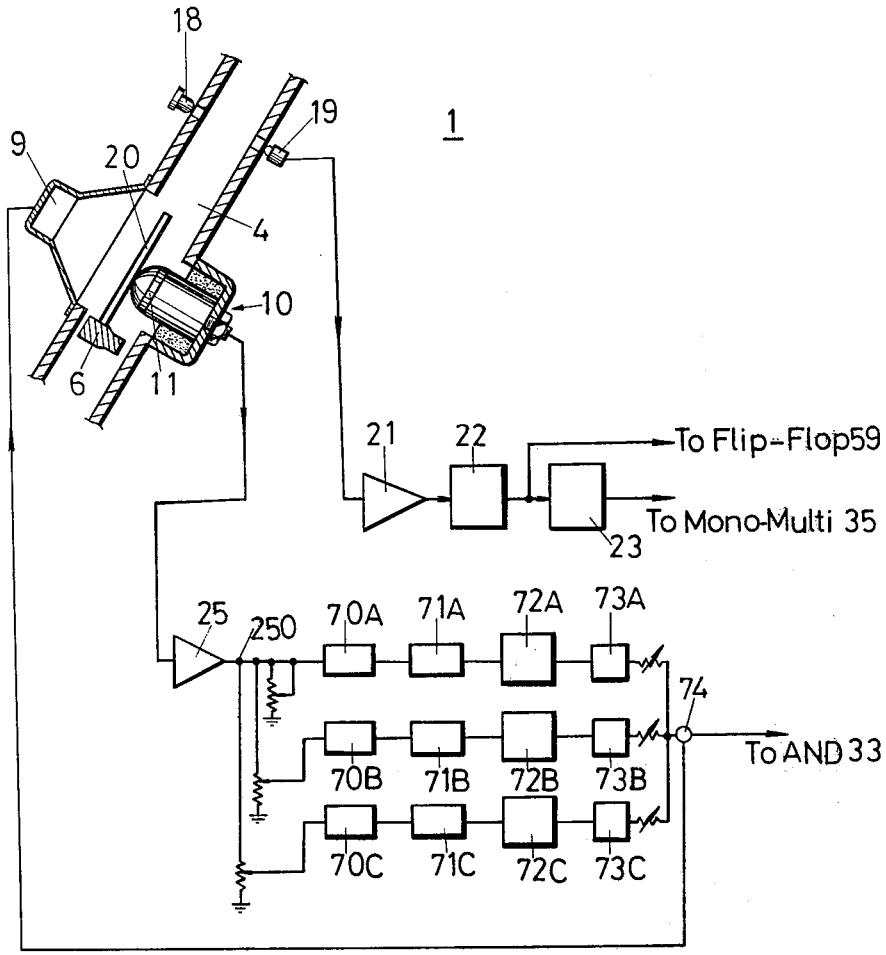
FIG. 7 shows another form of selective oscillator circuit.

FIG. 7 shows another form of oscillator circuits of the coin discriminating apparatus according to the invention. Parts similar to those shown in FIG. 3 are designated by like reference characters. In this embodiment, the piezo-electric element 11 of the pressure sensitive senser 10 is connected to the input terminal of amplifier 25 which has an output terminal 250. Three sets of circuits each comprising a phase shift circuit 70, a limiter 71, a band-pass filter 72 and an impedance matching circuit 73 connected in cascade connection with one another are inserted between the output terminal 250 of amplifier 25 and the speaker 9 through variable resistors. The symbols A, B and C appended to the end of reference numerals 70 to 73 indicate that the elements designated thereby belong to the channels of oscillation frequencies corresponding to the natural frequencies of the coins of 100 yen, 50 yen and 10 yen respectively. As can be seen in FIG. 7, the elements shown in the figure constitute a feedback amplifier oscillator circuit. In the positive feedback loop, the pressure sensitive senser 10, speaker 9 and the coin 20 interposed therebetween constitute a sort of mechanical filter as is the case with the embodiment shown in FIG. 3.

Upon the coin 20 fed to the apparatus being disposed as shown in FIG. 7 after impinging on the stopper 6, the normal feedback loop of the aforementioned oscillator circuit is closed. The shock vibration of the coin produced when it impinges on the stopper or a noise inside the amplifier 25 is amplified and appears at the output terminal 250 of amplifier 25. This output signal is passed through the phase shift circuit 70 and limiter 71 and applied to the band-pass filter 72. The band-pass filter 72, which may consist of LC-elements for example, passes a band which is equal to the maximum range of allowable values for the natural frequency of a coin which may be slightly damaged or deformed while in circulation or the range of allowable values for a genuine coin. Thus, the signal that has passed through the band-pass filter 72 only has the natural frequency component of the coin which energizes the speaker 9 through the impedance matching circuit 73. The sound output of the speaker 9 causes the coin 20 to vibrate and the vibration thereof is sensed by the pressure sensitive senser 10.

When the coin fed to the apparatus is genuine coin of 100 yen, 50 yen or 10 yen, the natural frequency of the coin exists in the frequency band passed by the band-pass filter 22A, 22B or 22C, so that the selective oscillator circuit selectively oscillates at the natural frequency of the particular coin. Thus, an oscillator output signal S2 of a constant voltage is produced at an output terminal 74 of the selective oscillator circuit. This oscillation frequency may vary depending on the type of coins. If the coin is of 10 yen, the frequency is about 13 KHz; if it is of 100 yen, the frequency is about 18 KHz; and if it is of 50 yen, the frequency is about 19 to 20 KHz.

The phase shift circuit 70 performs the function of shifting the phase so that the selective oscillator circuit may be subjected to positive feedback in a correct phase. The limiter 71 performs the function of limiting amplitude so that differences in oscillation level may not cause a change to occur in the output level.

From the foregoing description, it will be appreciated that the coin discriminating apparatus according to the invention permits to increase the degree of precision with which it is possible to determine whether a coin is a genuine coin or a false coin or what type is belongs to.

I claim:

1. A coin discriminating apparatus comprising: a coin detector means for sensing a coin fed to the apparatus and for producing a starting signal; a mechanical filter mechanism including a speaker, a pressure sensitive senser, a horizontally and vertically inclined passageway for said coin, a stopper for projection into said passageway, said coin fed to the apparatus being held between said speaker and said senser in said passageway by said stopper as said coin rolls down said passageway; a selective oscillator circuit having a positive feedback loop connected in series with said senser and speaker in which said mechanical filter mechanism is interposed to generate an oscillation output at the same frequency as the mechanical natural frequency of the coin fed to the apparatus; a one cycle selector circuit connected to said selective oscillator circuit adapted to take out one period of the oscillation frequency generated at said selective oscillator circuit; means connected to said one cycle selector circuit for producing impulses whose number depends on the wave length of said one period each time a coin is fed to the apparatus; and means connected to said means for producing impulses for determining whether the number of said impulses is within a range predetermined by a genuine coin to be discriminated.

2. An apparatus according to claim 1, wherein said detector means comprises: a coin passage switch disposed above said mechanical filter mechanism along said coin passageway; an amplifier connected to said coin passage switch; and a Schmitt trigger connected to said amplifier.

3. A coin discriminating apparatus comprising: a coin detector means for sensing a coin fed to the apparatus and for producing a starting signal; a mechanical filter mechanism including a speaker, a pressure sensitive senser, a horizontally and vertically inclined passageway for said coin, a stopper for projection into said passageway, said coin fed to the apparatus being held between said speaker and said senser in said passageway by said stopper as said coin rolls down said passageway; a selective oscillator circuit having a positive feedback loop connected in series with said senser and speaker in which said mechanical filter mechanism is interposed to generate an oscillation output at the same frequency as the mechanical natural frequency of the coin fed to the apparatus; a one cycle selector circuit connected to said selective oscillator circuit adapted to take out one period of the oscillation frequency generated at said selective oscillator circuit; means connected to said one cycle selector circuit for producing impulses whose number depends on the wave length of said one period each time a coin is fed to the apparatus; and means connected to said means for producing impulses for determining whether the number of said impulses is within a range predetermined by a genuine coin to be discriminated, wherein said coin passageway comprises an inclined coin passageway portion inclined with respect to a horizontal plane and a vertical plane passing therethrough, wherein said pressure sensitive senser comprises a piezo-electric element and a semi-spherical tip made of a synthetic resinous material and attached to the top of said piezo-electric element, said tip being adapted to cooperate with said stopper to hold at two points the coin when said stopper is projected into said inclined coin passageway portion.

4. A coin discriminating apparatus comprising: a coin detector means for sensing a coin fed to the apparatus and for producing a starting signal; a mechanical filter mechanism including a speaker, a pressure sensitive senser, a horizontally and vertically inclined passageway for said coin, a stopper for projection into said passageway, said coin fed to the apparatus being held between said speaker and said senser in said passageway by said speaker and said senser in said passageway by said stopper as said coin rolls down said passageway; a selective oscillator circuit having a positive feedback loop connected in series with said senser and speaker in which said mechanical filter mechanism is interposed to generate an oscillation output at the same frequency as the mechanical natural frequency of the coin fed to the apparatus; a one cycle selector circuit connected to said selective oscillator circuit adapted to take out one period of the oscillation frequency generated at said selective oscillator circuit; means connected to said one cycle selector circuit for producing impulses whose number depends on the wave length of said one period each time a coin is fed to the apparatus; and means connected to said means for producing impulses for determining whether the number of said impulses is within a range predetermined by a genuine coin to be discriminated, wherein said selective oscillator circuit comprises: a series circuit of a first gate and a limiter interposed in said positive feedback loop; a series circuit of a phase inverter and a second gate connected in parallel to said first gate: an astable multivibrator which is energized with the starting signal generated by said coin detector means so as alternately to open and close both gates; and means for locking the astable multivibrator into a state at which the feedback phase of the selective oscillator circuit is positive.

5. An apparatus according to claim 4, including a monostable multivibrator interposed between said coin detector means and said astable multivibrator.

6. A coin discriminating apparatus comprising: a coin detector means for sensing a coin fed to the apparatus and for producing a starting signal; a mechanical filter mechanism including a speaker, pressure sensitive senser, a horizontally and vertically inclined passageway for said coin, a stopper for projection into said passageway, said coin fed to the apparatus being held between said speaker and said senser in said passageway by said stopper as said coin rolls down said passageway; a selective oscillator circuit having a positive feedback loop connected in series with said senser and speaker in which said mechanical filter mechanism is interposed to generate an oscillation output at the same frequency as the mechanical natural frequency of the coin fed to the apparatus; a one cycle selector circuit connected to said selective oscillator circuit adapted to take out one period of the oscillation frequency generated at said selective oscillator circuit; means connected to said one cycle selector circuit for producing impulses whose number depends on the wave length of said one period each time a coin is fed to the apparatus; and means connected to said means for producing impulses for determining whether the number of said impulses is within a range predetermined by a genuine coin to be discriminated, wherein said selective oscillator circuit comprises at least one cascade connection circuit interposed in the positive feedback loop, said cascade connection circuit including a phase shift circuit, a limiter, a band phase filter and an impedance converter.

7. A coin discriminating apparatus comprising: a coin detector means for sensing a coin fed to the apparatus and for producing a starting signal; a mechanical filter mechanism including a speaker, a pressure sensitive senser, a horizontally and vertically inclined passageway for said coin, a stopper for projection into said passageway, said coin fed to the apparatus being held between said speaker and said senser in said passageway by said stopper as said coin rolls down said passageway; a selective oscillator circuit having a positive feedback loop connected in series with said senser and speaker in which said mechanical filter mechanism is interposed to generate an oscillation output at the same frequency as the mechanical natural frequency of the coin fed to the apparatus; a one cycle selector circuit connected to said selective oscillator circuit adapted to take out one period of the oscillation frequency generated at said selective oscillator circuit; means connected to said one cycle selector circuit for producing impulses whose number depends on the wave length of said one period each time a coin is fed to the apparatus; and means connected to said means for producing impulses for determining whether the number of said impulses is within a range predetermined by a genuine coin to be discriminated, including a collation processing timer connected to said coin detector.

8. An apparatus according to claim 7, wherein said one cycle selector comprises an AND circuit connected to said selective oscillator, a main flip-flop connected to the AND circuit, and a sub flip-flop connected to the main flip-flop said main and sub flip-flops capable of being preset by the output of said collation processing timer and said AND circuit capable of being opened by the reverse output of the sub flip-flop.

9. An apparatus according to claim 7, including an AND circuit connected to said collation processing timer for producing a collation ending signal for exciting a stopper solenoid, said AND circuit being opened by the reverse output of the one cycle selector.

10. A coin discriminating apparatus comprising: a coin detector means for sensing a coin fed to the apparatus and for producing a starting signal; a mechanical filter mechanism including a speaker, a pressure sensitive senser, a horizontally and vertically inclined passageway for said coin, a stopper for projection into said passageway, said coin fed to the apparatus being held between said speaker and said senser in said passageway by said stopper as said coin rolls down said passageway; a selective oscillator circuit having a positive feedback loop connected in series with said senser and speaker in which said mechanical filter mechanism is interposed to generate an oscillation output at the same frequency as the mechanical natural frequency of the coin fed to the apparatus; a one cycle selector circuit connected to said selective oscillator circuit adapted to take out one period of the oscillation frequency generated at said selective oscillator circuit; means connected to said one cycle selector circuit for producing impulses whose number depends on the wave length of said one period each time a coin is fed to the apparatus; and means connected to said means for producing impulses for determining whether the number of said impulses is within a range predetermined by a genuine coin to be discriminated, including a definite oscillation discriminator comprising an AND circuit and a rectifier circuit interposed between the both inputs of said AND circuit, said definite oscillation discriminator being interposed between said selective oscillator and said cycle selector.

11. A coin discriminating apparatus comprising: a coin detector means for sensing a coin fed to the apparatus and for producing a starting signal; a mechanical filter mechanism including a speaker, a pressure sensitive senser, a horizontally and vertically inclined passageway for said coin, a stopper for projection into said passageway, said coin fed to the apparatus being held between said speaker and said senser in said passageway by said stopper as said coin rolls down said passageway; a selective oscillator circuit having a positive feedback loop connected in series with said senser and speaker in which said mechanical filter mechanism is interposed to generate an oscillation output at the same frequency as the mechanical natural frequency of the coin fed to the apparatus; a one cycle selector circuit connected to said selective oscillator circuit adapted to take out one period of the oscillation frequency generated at said selective oscillator circuit; means connected to said one cycle selector circuit for producing impulses whose number depends on the wave length of said one period each time a coin is fed to the apparatus; and means connected to said means for producing impulses for determining whether the number of said impulses is within a range predetermined by a genuine coin to be discriminated, wherein said means for determining whether or not the number of pulses is within a predetermined range comprises counter means having at least one ring counter at and at least one decoder unit connected to said ring counter, at least one OR circuits having a pair of input terminals connected to any pair of a plurality of output terminals of said at least one decoder unit corresponding to a leading value and a trailing value of a predetermined range of values allowable for the cycle of the natural frequency of one of more than two types of coins being deemed a genuine coin in circulation, and at least one descriminating flip-flop connected to one of said OR circuits and disposed posterior thereto.

12. An apparatus according to claim 11, including a collation processing timer connected to said coin detector, a first AND circuit connected to said collation processing timer and the reverse output of said one cycle selector, and at least one AND circuit connected to one of the discriminating flip-flops and to said first AND circuit.

13. An apparatus according to claim 11, including a collation processing timer connected to said coin detector, a first AND circuit connected to said collation processing timer and the reverse output of said one cycle selector, a second AND circuit connected to each of the reverse outputs of the discriminating flip-flops and to said first AND circuit, and a discrimination solenoid excited by the output of said second AND circuit to introduce a coin into a return port through a branch passageway.

14. An apparatus according to claim 11, including AND circuits each interposed between one of said OR circuits and one of said discriminating flip-flops, a flip-flop connected to said coin detector to gate said AND circuits corresponding to the difference between perforated and non-perforated coins fed to the apparatus.

* * * * *

UNITED STATES PATENT OFFICE

CERTIFICATE OF CORRECTION

Patent No. 3,939,953 Dated February 24,1976

Inventor(s) KUNIAKI MIYAZAWA

It is certified that error appears in the above-identified patent and that said Letters Patent are hereby corrected as shown below:

Column 7, line 35 should read as follows:

--which are 515 to 535, 542 to 557 and 735 to 775 re- --

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*